US010309255B2

(12) United States Patent
Romanov

(10) Patent No.: US 10,309,255 B2
(45) Date of Patent: Jun. 4, 2019

(54) BLADE OUTER AIR SEAL COOLING PASSAGE

(71) Applicant: UNITED TECHNOLOGIES CORPORATION, Farmington, CT (US)

(72) Inventor: Dmitriy A. Romanov, Wells, ME (US)

(73) Assignee: United Technologies Corporation, Farmington, CT (US)

( * ) Notice: Subject to any disclaimer, the term of this patent is extended or adjusted under 35 U.S.C. 154(b) by 390 days.

(21) Appl. No.: 15/104,092

(22) PCT Filed: Dec. 10, 2014

(86) PCT No.: PCT/US2014/069570

§ 371 (c)(1),
(2) Date: Jun. 13, 2016

(87) PCT Pub. No.: WO2015/130380

PCT Pub. Date: Sep. 3, 2015

(65) Prior Publication Data

US 2016/0319698 A1 Nov. 3, 2016

Related U.S. Application Data

(60) Provisional application No. 61/918,249, filed on Dec. 19, 2013.

(51) Int. Cl.
*F01D 5/14* (2006.01)
*F01D 25/12* (2006.01)
(Continued)

(52) U.S. Cl.
CPC ..... *F01D 25/12* (2013.01); *F01D 11/08* (2013.01); *F01D 11/24* (2013.01);
(Continued)

(58) Field of Classification Search
CPC ..... F01D 11/24; F01D 25/12; F01D 11/06; F05D 2260/22141; F05D 2240/11;
(Continued)

(56) References Cited

U.S. PATENT DOCUMENTS 4,573,865 A * 3/1986 Hsia ..... F01D 5/187 165/109.1
5,092,735 A * 3/1992 Katy ..... F01D 11/08 415/115
(Continued)

FOREIGN PATENT DOCUMENTS

CA 2712758 2/2011
CA 2713284 2/2011
(Continued)

OTHER PUBLICATIONS

International Preliminary Report on Patentability for PCT Application No. PCT/US2014/069570, dated Jun. 30, 2016.
(Continued)

*Primary Examiner* — Umashankar Venkatesan
(74) *Attorney, Agent, or Firm* — Carlson, Gaskey & Olds, P.C.

(57) ABSTRACT

A gas turbine engine component includes a structure including a first wall and a second wall that provide a cooling passage. The cooling passage extends a length from a first end to a second end. A cluster of impingement inlet holes is provided in the second wall at the first end. An outlet is provided at the second end.

9 Claims, 4 Drawing Sheets

(51) Int. Cl.
*F01D 11/24* (2006.01)
*F01D 11/08* (2006.01)

(52) U.S. Cl.
CPC ..... *F05D 2220/32* (2013.01); *F05D 2240/11* (2013.01); *F05D 2240/127* (2013.01); *F05D 2260/201* (2013.01); *F05D 2260/2212* (2013.01); *F05D 2260/22141* (2013.01)

(58) Field of Classification Search
CPC ..... F05D 2240/127; F05D 2260/2212; F05D 2220/32; F05D 2260/201
USPC ..... 415/115
See application file for complete search history.

(56) References Cited

U.S. PATENT DOCUMENTS

| | | | | |
|---|---|---|---|---|
| 5,375,973 | A | 12/1994 | Sloop et al. | |
| 5,391,052 | A * | 2/1995 | Correia | F01D 11/10 415/115 |
| 7,335,429 | B2 | 2/2008 | Lee et al. | |
| 7,513,040 | B2 | 4/2009 | Cunha et al. | |
| 7,686,068 | B2 * | 3/2010 | Tholen | B22C 9/04 164/35 |
| 8,439,629 | B2 | 5/2013 | Pietraszkiewicz et al. | |
| 2006/0140753 | A1 | 6/2006 | Romanov et al. | |
| 2006/0182622 | A1 * | 8/2006 | Parker | F01D 11/08 415/116 |
| 2007/0020088 | A1 * | 1/2007 | Durocher | F01D 11/24 415/115 |
| 2007/0248462 | A1 | 10/2007 | Lutjen et al. | |
| 2008/0079523 | A1 * | 4/2008 | Tholen | F01D 11/08 336/60 |
| 2008/0089787 | A1 | 4/2008 | Abdel-Messeh et al. | |
| 2008/0118346 | A1 * | 5/2008 | Liang | F01D 11/005 415/115 |
| 2008/0211192 | A1 * | 9/2008 | Pietraszkiewicz | F01D 11/08 277/347 |
| 2012/0163975 | A1 | 6/2012 | Propheter-Hinckley | |
| 2012/0189426 | A1 | 7/2012 | Thibodeau et al. | |
| 2012/0272654 | A1 * | 11/2012 | Kaleeswaran | F23R 3/002 60/772 |
| 2013/0071227 | A1 | 3/2013 | Thibodeau | |
| 2013/0327056 | A1 | 12/2013 | Cunha | |

FOREIGN PATENT DOCUMENTS

| | | |
|---|---|---|
| EP | 1905958 | 4/2008 |
| EP | 2098690 | 9/2009 |
| EP | 2518406 | 10/2012 |
| EP | 2570613 | 3/2013 |
| JP | H0552102 | 3/1993 |
| WO | 2011020485 | 2/2011 |
| WO | 2014008017 | 1/2014 |
| WO | 2014081492 | 5/2014 |
| WO | 2015026598 | 2/2015 |

OTHER PUBLICATIONS

European Search Report for European Application No. 14883695.0 dated Aug. 14, 2017.
International Search Report and Written Opinion for PCT Application No. PCT/US2014/069570, dated Sep. 10, 2016.

* cited by examiner

BLADE OUTER AIR SEAL COOLING PASSAGE

CROSS-REFERENCE TO RELATED APPLICATIONS

This application claims priority to U.S. Provisional Application No. 61/918,249, which was filed on Dec. 19, 2013 and is incorporated herein by reference.

STATEMENT REGARDING FEDERALLY SPONSORED RESEARCH OR DEVELOPMENT

This invention was made with government support with the United States Air Force under Contract No.: FA8650-09-D-2923 0021. The government therefore has certain rights in this invention.

BACKGROUND

This disclosure relates to a blade outer air seal (BOAS) and, more particularly, to a cooling passage for a BOAS.

Gas turbine engines generally include fan, compressor, combustor and turbine sections along an engine axis of rotation. The fan, compressor, and turbine sections each include a series of stator and rotor blade assemblies. A rotor and an axially adjacent array of stator assemblies may be referred to as a stage. Each stator vane assembly increases efficiency through the direction of core gas flow into or out of the rotor assemblies.

An outer case supports multiple BOAS, which provide an outer radial flow path boundary. The BOAS are designed to accommodate thermal and dynamic variation typical in a high pressure turbine (HPT) section of the gas turbine engine. The BOAS are subjected to relatively high temperatures and receive a secondary cooling airflow for temperature control. The secondary cooling airflow is communicated into the BOAS through cooling channels within the BOAS for temperature control.

One type of BOAS includes multiple discrete cooling passages, each of which are fed cooling fluid through a single inlet hole in a backside of the BOAS. The cooling passages included chevron-shaped turbulators along the entire length of the cooling passage to improve cooling one the core gas flow side of the BOAS.

SUMMARY

In one exemplary embodiment, a gas turbine engine component includes a structure including a first wall and a second wall that provide a cooling passage. The cooling passage extends a length from a first end to a second end. A cluster of impingement inlet holes is provided in the second wall at the first end. An outlet is provided at the second end.

In a further embodiment of the above, the structure is a blade outer air seal.

In a further embodiment of any of the above, the cooling passage extends in a circumferential direction and is provided between lateral walls. The outlet is provided in one of the lateral walls.

In a further embodiment of any of the above, the structure includes multiple parallel cooling passages.

In a further embodiment of any of the above, the first wall includes a sealing surface. The second wall provides an outer wall that is configured to be in fluid communication with a cooling source.

In a further embodiment of any of the above, at least one of the first and second walls includes turbulators that are arranged downstream from the cluster of impingement inlet holes.

In a further embodiment of any of the above, the turbulators are chevrons.

In a further embodiment of any of the above, a first region is provided within the cooling passage beneath the cluster of impingement inlet holes. A second region includes the turbulators.

In a further embodiment of any of the above, the first region extends in the range of 25-65% of the length.

In a further embodiment of any of the above, the first region has lower fluid friction than the second region.

In another exemplary embodiment, a gas turbine engine component includes a structure that includes a first wall and a second wall that provide a cooling passage. The cooling passage extends a length from a first end to a second end. An impingement inlet hole is provided in the second wall at the first end. An outlet is provided at the second end. A first region is provided within the cooling passage beneath the impingement inlet hole. A second region includes turbulators. The first region extends in the range of 25-65% of the length.

In a further embodiment of the above, the structure is a blade outer air seal.

In a further embodiment of any of the above, the cooling passage extends in a circumferential direction and is provided between lateral walls. The outlet is provided in one of the lateral walls.

In a further embodiment of any of the above, the structure includes multiple parallel cooling passages.

In a further embodiment of any of the above, the first wall includes a sealing surface. The second wall provides an outer wall that is configured to be in fluid communication with a cooling source.

In a further embodiment of any of the above, at least one of the first and second walls includes turbulators that are arranged downstream from a cluster of inlet holes in the second wall.

In a further embodiment of any of the above, the turbulators are chevrons.

In a further embodiment of any of the above, the first region is provided within the cooling passage beneath the cluster of impingement inlet holes.

In a further embodiment of any of the above, the second region has a Darcy friction factor that is higher than a Darcy friction factor of the first region.

In a further embodiment of any of the above, the first region has a Darcy friction factor of around 1.0, and the second region has a Darcy friction factor of around 8.4.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
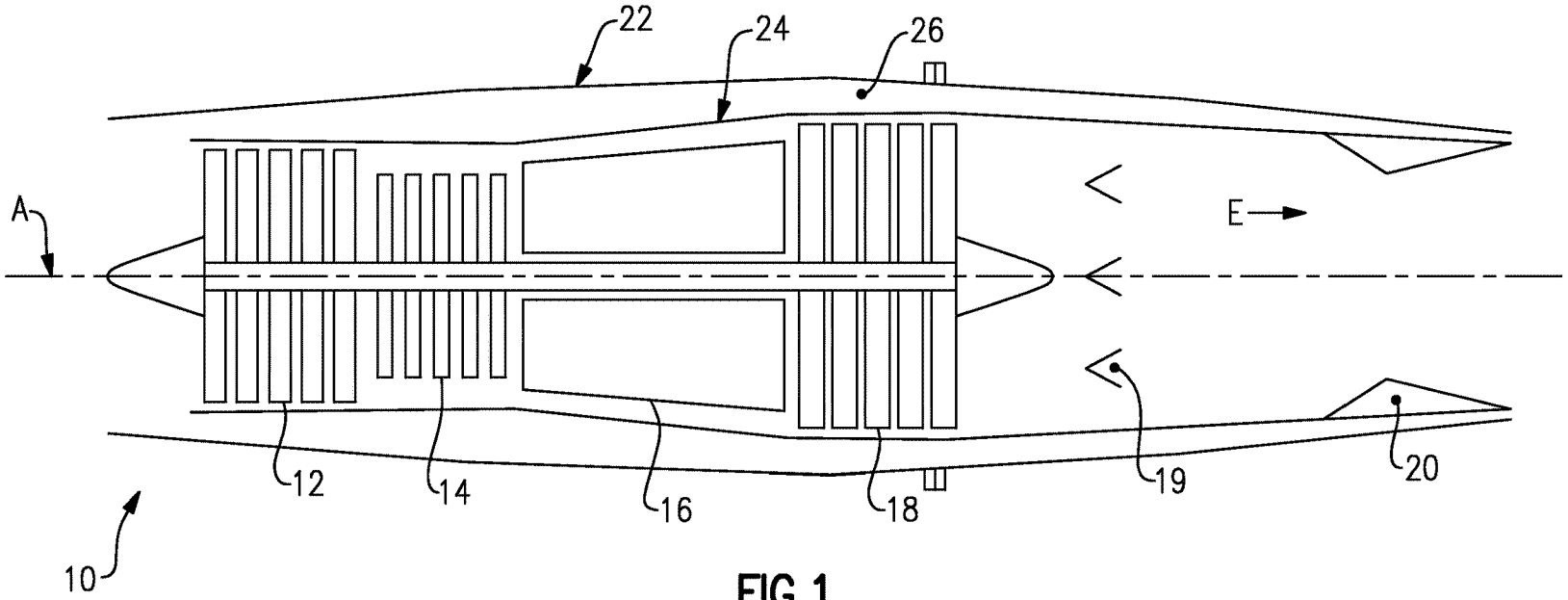
FIG. 1 is a highly schematic view of an example turbojet engine.

FIG. 1 illustrates an example turbojet engine 10. The engine 10 generally includes a fan section 12, a compressor section 14, a combustor section 16, a turbine section 18, an augmentor section 19 and a nozzle section 20. The compressor section 14, combustor section 16 and turbine section 18 are generally referred to as the core engine. An axis A of the engine 10 extends longitudinally through the sections. An outer engine duct structure 22 and an inner cooling liner structure 24, or exhaust liner, provide an annular secondary fan bypass flow path 26 around a primary exhaust flow path E.

While a military engine is shown, the disclosed blade outer air seal may be used in commercial and industrial gas turbine engines as well. The examples described in this disclosure is not limited to a single-spool gas turbine and may be used in other architectures, such as a two-spool axial design, a three-spool axial design, and still other architectures. That is, there are various types of gas turbine engines, and other turbomachines, that can benefit from the examples disclosed herein.

Figure 2:
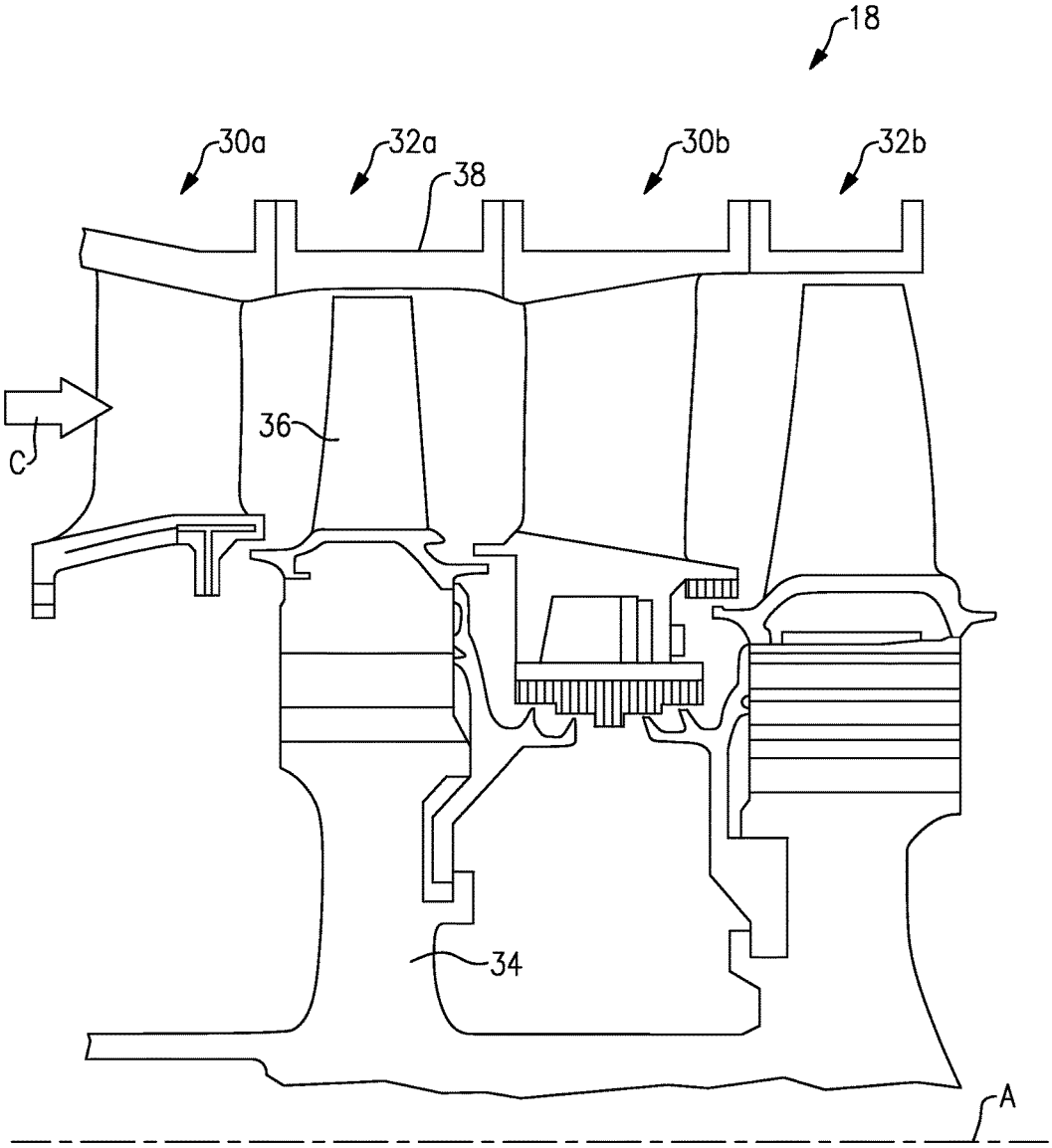
FIG. 2 is a schematic view of a turbine section of an example engine.

The example turbine section 18 includes multiple fixed stages 30*a*, 30*b* and multiple rotatable stages 32*a*, 32*b*, schematically shown in FIG. 2. Fewer or greater number of fixed and/or rotating stages may be used than depicted, if desired.

One of the rotatable stages 32*a* includes a rotor 34 supporting a circumferential array of blades 36 for rotation about the axis A. Blade outer air seals (BOAS) 38, which are typically provided by multiple arcuate segments, are supported by the static structure of the engine to provide an annular gas seal relative to core gas flow C through the blades 36.

Figure 3:
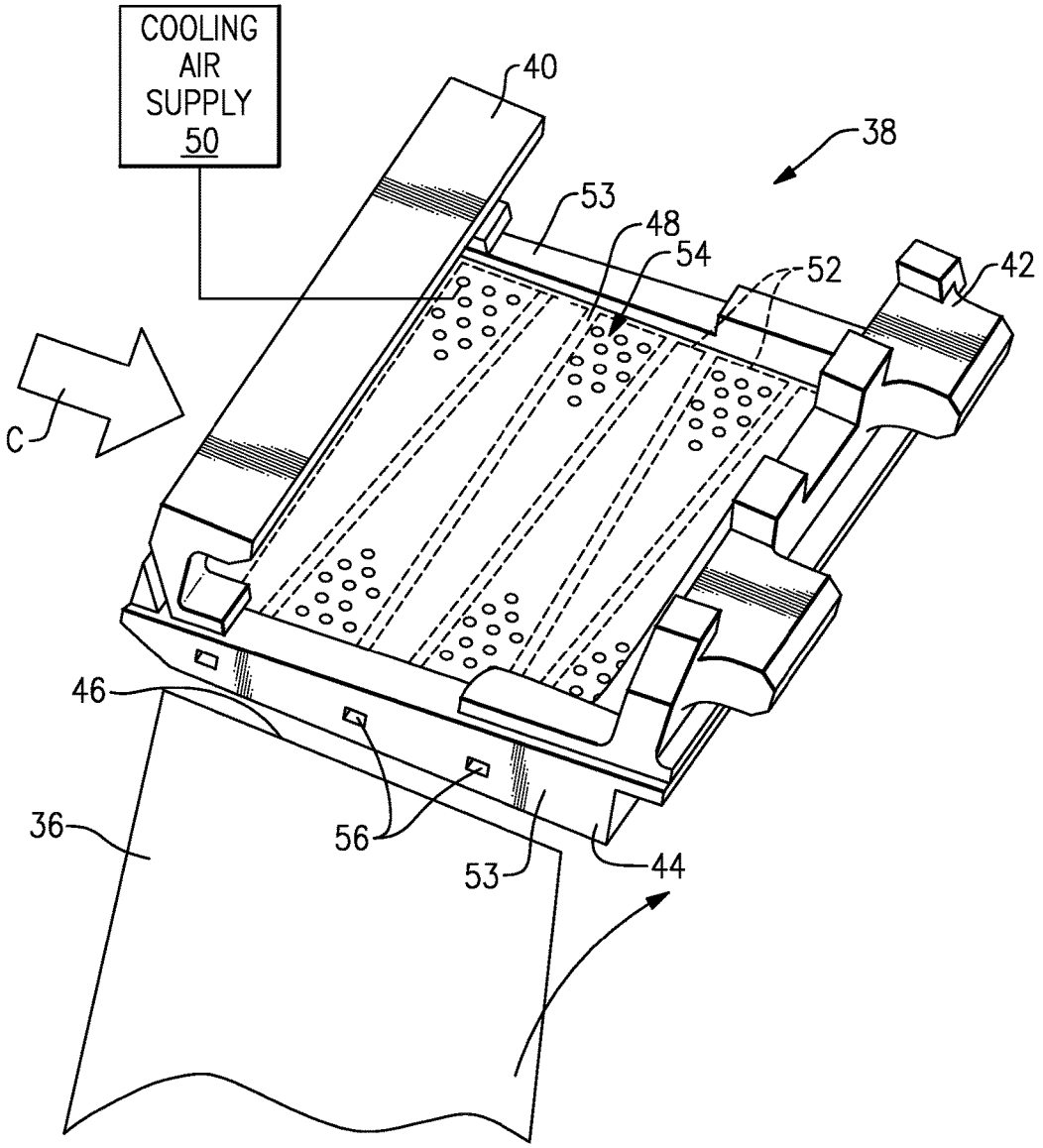
FIG. 3 is a schematic view of a blade outer air seal.

Referring to FIG. 3, the (BOAS) 38 includes forward and aft hooks 40, 42 used to secure the BOAS to the static structure. The BOAS 38 includes a first wall 44 providing a sealing surface that provides a gas seal relative to a tip 46 of the blade 36. A second wall 48 is spaced from the first wall 44 and provides an outer wall that is in fluid communication with a cooling air supply 50. The cooling air supply may be provided by an upstream stage, such as air from the compressor section.

One or more cooling passages 52 are provided in the BOAS 38 between the first and second walls 44, 48. In the example, the multiple cooling passages are provided parallel to one another and arranged in a first or circumferential direction. In one example, around six to ten cooling passages 52 may be provided in a blade outer air seal 38.

A cluster of impingement inlet holes 54 is provided in the second wall 48 and is in fluid communication with the cooling air supply 50 to supply the cooling air to the cooling passages 52. The impingement holes 54 may be provided using a drilling or electro discharge machining process, for example. Outlets 56 are in fluid communication with the cooling passages 52 and may be provided in spaced apart lateral walls 53 that are next to circumferentially adjacent BOAS. The outlets 56 purge core gas flow from the gap between the adjacent BOAS.

Figure 4:
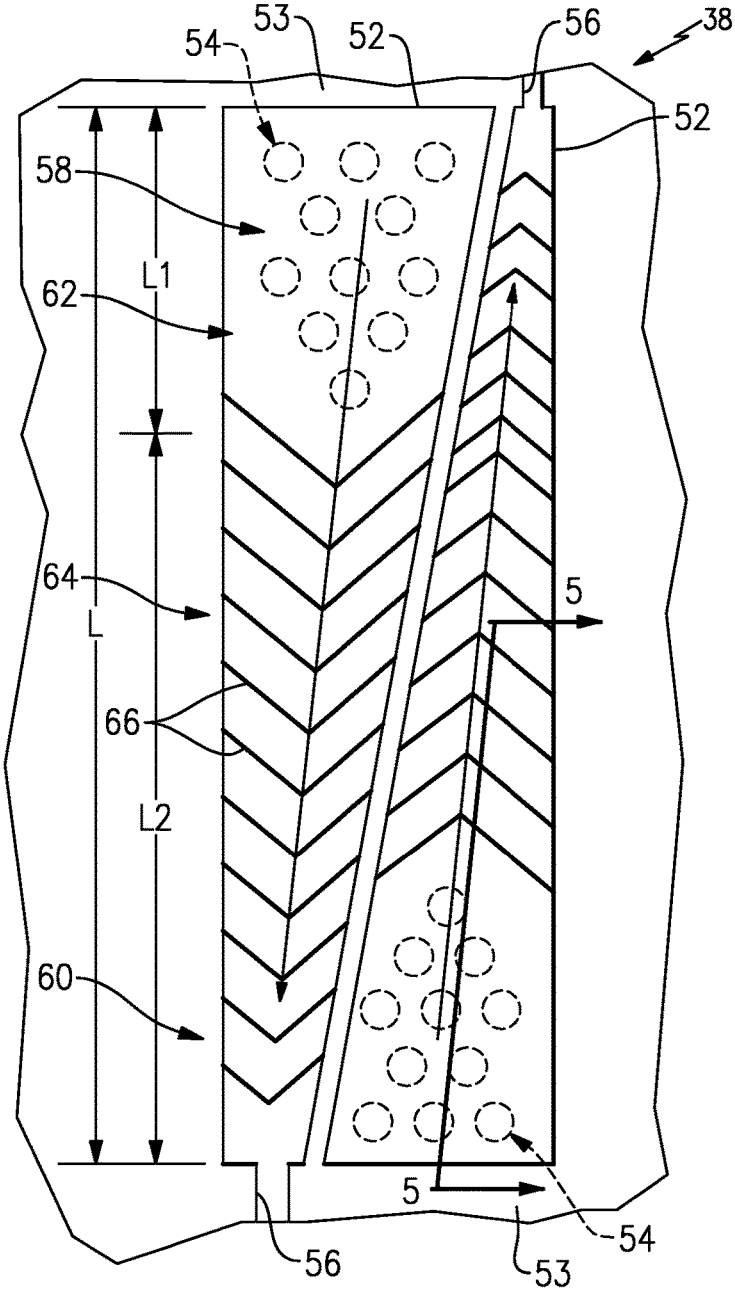
FIG. 4 is a cross-sectional view of a blade outer air seal taken along line 4-4 of FIG. 5.
Figure 5:
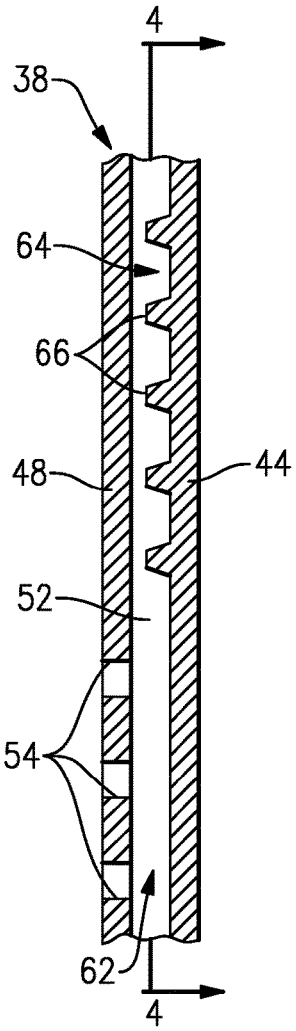
FIG. 5 is a cross-sectional view of a blade outer air seal taken along line 5-5 of FIG. 4.

Referring to FIGS. 4 and 5, the cooling passage 52 extends a length L from a first end 58 to a second end 60. The outlet 56 is provided in the second end 60. First and second regions 62, 64 are respectively arranged at the first and second ends 58, 60.

The impingement holes 54 is arranged at the first end 58 such that cooling air impinges upon the first wall 48 in the first region 62. In the example, the first region includes relatively smooth walls providing a Darcy friction factor of around 1.0. The first region extends along the cooling passage 52 a length L1 in the range of 25-65%, and in one example, 30-60%.

Turbulators 66 are provided in the second region 64, which is arranged downstream from the impingement holes 54. In the example, the turbulators 66 are provided by an array of chevron-shaped protrusions extending from at least one of the first and second walls 44, 48. In the example, the turbulators 66 are provided on the first wall 44, which reduces the heat from the core gas flow path. In one example, the second region 64, extending a length L2, has higher friction factor than in the first region 62. In one example, the Darcy friction factor of the second region is around 8.4.

The disclosed blade outer air seal cooling scheme may also be used in a compressor section, if desired, as well as other gas turbine engine components, such as vanes, blades, exhaust liners, combustor liners, or augmenter liners.

The blade outer air seal reduces the friction losses within the cooling passages because first region 62 has lower fluid friction than in second region 64, as compared to prior art blade outer air seals. The cooling passage also provides a higher inlet area and reduces the flow restriction into the cooling passage. As a result, a reduced amount of supply pressure is needed for the same amount of cooling as compared to prior art cooling passages. Using a lower pressure cooling fluid reduces leakage and increases the cooling capacity for the same amount of cooling fluid flow.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine component comprising:

a structure including a first wall and a second wall that provide a cooling passage, the cooling passage extends a length from a first end to a second end, a cluster of impingement inlet holes is provided in the second wall at the first end, and an outlet is provided at the second end wherein a first region is provided within the cooling passage beneath the cluster of impingement inlet holes, and a second region includes turbulators, the first region extends in the range of 25-65% of the length and has lower fluid friction than the second region, and the first region is without the turbulators, wherein the structure includes multiple parallel discrete cooling passages each having the outlet and the cluster of impingement inlet holes arranged on opposite sides of the structure.

2. The gas turbine engine component according to claim 1, wherein the structure is a blade outer air seal.

3. The gas turbine engine component according to claim 2, wherein the cooling passage extends in a circumferential direction and is provided between lateral walls, the outlet provided in one of the lateral walls.

4. The gas turbine engine component according to claim 3, wherein the structure includes multiple parallel cooling passages.

5. The gas turbine engine component according to claim 2, wherein the first wall includes a sealing surface, and the second wall provides an outer wall configured to be in fluid communication with a cooling source.

6. The gas turbine engine component according to claim 1, wherein at least one of the first and second walls includes turbulators arranged downstream from the cluster of impingement inlet holes.

7. The gas turbine engine component according to claim 6, wherein the turbulators are chevrons.

8. The gas turbine engine component according to claim 1, wherein the second region has a Darcy friction factor that is higher than a Darcy friction factor of the first region.

9. The gas turbine engine component according to claim 8, wherein the first region has a Darcy friction factor of around 1.0, and the second region has a Darcy friction factor of around 8.4.

* * * * *